US006649275B1

(12) United States Patent
Ishizuka et al.

(10) Patent No.: US 6,649,275 B1
(45) Date of Patent: Nov. 18, 2003

(54) ZINC PHOSPHATE-TREATED GALVANIZED STEEL SHEET EXCELLENT IN CORROSION RESISTANCE AND COLOR TONE

(75) Inventors: Kiyokazu Ishizuka, Himeji (JP); Hidetoshi Shindo, Himeji (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/172,864

(22) Filed: Jun. 17, 2002

(51) Int. Cl.[7] ..... B32B 15/04

(52) U.S. Cl. ..... 428/472.3; 428/628; 428/659; 428/687

(58) Field of Search ..... 428/472.3, 628, 428/659, 687

(56) References Cited

U.S. PATENT DOCUMENTS 6,376,092 B1 * 4/2002 Ishizuka et al. ..... 428/472.3

FOREIGN PATENT DOCUMENTS

| | | |
|---|---|---|
| JP | 1-312081 | 12/1989 |
| JP | 2-101175 | 4/1990 |
| JP | 3-107469 | 5/1991 |
| JP | 9-49086 | 2/1997 |
| WO | WO 00/73535 | 12/2000 |

* cited by examiner

*Primary Examiner*—Robert R. Koehler
(74) *Attorney, Agent, or Firm*—Kenyon & Kenyon

(57) ABSTRACT

A zinc phosphate treated galvanized steel sheet capable of securing sufficient white rust resistance and non-uniform dew condensation resistance without requiring a sealing chromate treatment has high white color and is excellent in color tone uniformity. The galvanized steel sheet has a zinc phosphate film containing at least 2% of Mg and 0.01 to 1% of at least one element selected from the group consisting of Ni, Co and Cu, and the adhesion value of the zinc phosphate film is at least 0.7 g/m$^2$.

1 Claim, No Drawings

ZINC PHOSPHATE-TREATED GALVANIZED STEEL SHEET EXCELLENT IN CORROSION RESISTANCE AND COLOR TONE

BACKGROUND OF THE INVENTION

1. Field of the Invention

This invention relates to a zinc phosphate-treated galvanized steel sheet, having excellent corrosion resistance and color tone, that can be used for applications such as household electric appliances, building materials, automobiles and so forth.

2. Description of the Related Art

Zinc phosphate-treated steel sheets for use in automobiles, household electric appliances and building materials have been subjected in the past to zinc phosphate treatment, chromate treatment and organic coating treatment to improve qualities such as corrosion resistance and coating performance. However, the use of the chromate-treated steel sheets, in particular, has been prevented in recent years, to prevent possible environmental pollution, because it may contain hexavalent chromium, and the demands on zinc phosphate treatments have increased.

When the zinc phosphate treatment is used alone, however, resistance to white rust and resistance to non-uniform dew condensation are entirely insufficient, and a rinsing treatment in a hexavalent chromium-containing aqueous solution called "sealing chromate treatment", "sealing treatment" or "post-treatment", has been generally carried out. From the aspect of environmental preservation, therefore, the zinc phosphate treatment is essentially not sufficient, and the development of a method capable of improving the white rust resistance and the non-uniform dew condensation resistance, and being free of any environmental problem, has been desired.

A uniform white appearance is required in most cases for the zinc phosphate-treated galvanized steel sheets. If the color tone of an underlying film is dark when white coating is applied, the color tone after coating becomes dark, too, and the commercial value drops.

To cope with this problem, Japanese Patent No. 2,770,860, for example, describes a treatment method using a formation treating solution containing Zn ions and Mg ions in specific concentrations. Since this method is based on the premise of the sealing chromate treatment, however, the corrosion resistance is not sufficient. Japanese Unexamined Patent Publication (Kokai) No. 9-49086 describes a phosphate treatment method providing a steel sheet having high whiteness and excellent in adhesion by using a formation treatment solution containing Ni ions and Mg ions in specific concentrations. According to this method, however, the corrosion resistance, particularly white rust resistance, and the non-uniform dew condensation resistance are not sufficient and the whiteness and its uniformity are-not sufficient, either. Japanese Unexamined Patent Publications (Kokai) No. 1-312081 and No. 3-107469 disclose a zinc plated steel sheet having an Mg-containing phosphate film. The corrosion resistance, particularly white rust resistance, and the non-uniform dew condensation resistance are not sufficient in this method. Though this method provides high whiteness, this method is not sufficient from the aspect of uniformity of the color tone. WO00/73535 describes a zinc plated steel sheet that has a phosphate film containing Mg and Ni or Mn formed thereon and is excellent in the corrosion resistance (red rust resistance) and coating performance. When directed to obtain uniform white appearance and excellent white rust resistance and non-uniform dew condensation resistance, however, this method is not entirely satisfactory.

SUMMARY OF THE INVENTION

This invention aims at providing a zinc phosphate-treated galvanized steel sheet that solves the problem described above, does not require the sealing chromate treatment, can secure sufficient white rust resistance and non-uniform dew condensation resistance, has high whiteness and is excellent in color tone.

The present inventors have examined the influence of metal components other than Zn in the zinc phosphate-treated film formed on the galvanized steel sheet, and have found that the white rust resistance, non-uniform dew condensation resistance, whiteness and color tone uniformity can be improved when a relatively large amount of Mg is contained, but this means is not sufficient when it is alone used. When suitable amounts of Ni, Co and Cu, that are electrochemically more noble than Zn, are allowed to precipitate beside Mg, these elements operate as the nuclei with the result that a compact and uniform film can be formed, and the object of the present invention can be achieved.

The gist of the present invention resides in a zinc plated steel sheet having a zinc phosphate film, wherein the zinc phosphate film contains at least 2% of Mg and 0.01 to 1% of at least one element selected from the group consisting of Ni, Co and Cu, and the adhesion value of the film is at least 0.7 $g/m^2$.

DESCRIPTION OF THE PREFERRED EMBODIMENTS

The galvanized steel sheet used in the present invention is not particularly limited, and both pure zinc plating and alloy plating can be used. The plating means is not particularly limited, either, and electroplating, hot-dip plating, vacuum deposition, and so forth, can be employed.

In the zinc phosphate film formed on the galvanized plating, Mg and an element selected from the group consisting of Ni, Co and Cu must essentially co-exist as metal components other than zinc. The amount of Mg is at least 2% and the amount of at least one kind of elements selected from the group consisting of Ni, Co and Cu must be from 0.01 to 1%. When the amount of either one of these components is below the respective lower limits, the white rust resistance and the non-uniform dew condensation resistance are deteriorated and uniformity of the color tone drops. When co-present, these elements form a compact and uniform white skin film having less pits. The upper limit of at least one kind of elements selected from the group consisting of Ni, Co and Cu is set to 1% because the color tone becomes dark and uniformity of the color tone drops when the amount exceeds this upper limit of 1%.

The adhesion value of the zinc phosphate film is at least 0.7 $g/m^2$. When the amount is less than this value, the white rust resistance and the non-uniform dew condensation resistance drop.

The zinc phosphate type galvanized steel sheet according to the present invention does not require a sealing chromate treatment after the zinc phosphate treatment. A sealing treatment not containing Cr is naturally advantageous from the aspect of corrosion resistance, but is not necessary.

The zinc phosphate film of the invention can be formed by conducting an ordinary treatment such as spraying or dipping in an ordinary zinc phosphate treating bath containing phosphoric acid ions, Zn ions or nitric acid ions and fluorides by adding ions of Mg, Ni, Co, Cu, etc, in the form of nitrates to the treating bath.

EXAMPLES AND COMPARATIVE EXAMPLES

Examples 1 to 3 & Comparative Example 1

A titanium colloid type pre-treatment was applied to a molten zinc plated steel sheet having a Zn plating amount of 60 g/m$^2$ (per face). The steel sheet was then treated by spraying a phosphate treatment bath containing 3.5 g/l of Zn ion, 20 g/l of Mg ions and 2 g/l of Ni ions, was washed with water and was then dried. Samples of Comparative Example 1 and Examples 1 to 3 were prepared by changing the spray time.

Example 4

After the titanium colloid type pre-treatment was applied to a steel sheet in the same way as described above Examples 1 to 3, a phosphate treatment bath containing 4 g/l of Zn ions, 15 g/l of Mg ions and 1 g/l of Ni ions was applied by spraying to the steel sheet. Then, the steel sheet was washed with water and was dried to prepare a sample of Example 4.

Example 5

After the titanium colloid type pre-treatment was applied to a steel sheet in the same way as described above Examples 1 to 3, a phosphate treatment bath containing 2 g/l of Zn ions, 24 g/l of Mg ions and 0.5 g/l of Ni ions was applied by spraying to the steel sheet. Then, the steel sheet was washed with water and was dried to prepare a sample of Example 5.

Example 6

After the titanium colloid type pre-treatment was applied to a steel sheet in the same way as described above Examples 1 to 3, a phosphate treatment bath containing 2 g/l of Zn ions, 24 g/l of Mg ions and 0.5 g/l of Co ions was applied by spraying to the steel sheet. Then, the steel sheet was washed with water and was dried to prepare a sample of Example 6.

Example 7

After the titanium colloid type pre-treatment was applied to a steel sheet in the same way as described above Examples 1 to 3, a phosphate treatment bath containing 2 g/l of Zn ions, 24 g/l of Mg ions and 0.5 g/l of Co ions was applied by spraying to the steel sheet. Then, the steel sheet was washed with water and was dried to prepare a sample of Example 7.

Example 8

A titanium colloid type pre-treatment was applied to a molten Zn-0.5%Mg alloy plated steel sheet having a Zn plating amount of 60 g/m$^2$ (per face). The steel sheet was then treated by spraying a phosphate treatment bath containing 4 g/l of Zn ion, 15 g/l of Mg ions and 1 g/l of Ni ions, was washed with water and was then dried to prepare a sample of Example 8.

Example 9

A titanium colloid type pre-treatment was applied to a Zn-1%Co alloy electro-plated steel sheet having a Zn plating amount of 20 g/m$^2$ (per face). The steel sheet was then treated by spraying a phosphate treatment bath containing 4 g/l of Zn ion, 15 g/l of Mg ions and 1 g/l of Ni ions, was washed with water and was then dried to prepare a sample of Example 9.

Example 10

A titanium colloid type pre-treatment was applied to a 0.05Ni-containing zinc electro-plated steel sheet (having a Zn plating amount of 20 g/m$^2$ (per face)). The steel sheet was then treated by spraying a phosphate treatment bath containing 4 g/l of Zn ion, 15 g/l of Mg ions and 0.02 g/l of Ni ions, was washed with water and was then dried to prepare a sample of Example 10.

Comparative Example 2

A titanium colloid type pre-treatment was applied to a molten zinc plated steel sheet having a Zn plating amount of 60 g/m$^2$ (per face). The steel sheet is then treated by spraying a phosphate treatment bath containing 2 g/l of Zn ion, 9 g/l of Mg ions and 1 g/l of Ni ions, was washed with water and was then dried to prepare a sample of Comparative Example 2.

Comparative Example 3

After the titanium colloid type pre-treatment was applied to a steel sheet in the same way as described above Comparative Example 2, a phosphate treatment bath containing 1.5 g/l of Zn ions and 15 g/l of Mg ions is applied by spraying to the steel sheet. Then, the steel sheet was washed with water and was dried to prepare a sample of Comparative Example 3.

Comparative Example 4

After the titanium colloid type pre-treatment was applied to a steel sheet in the same way as described above Comparative Example 2, a phosphate treatment bath containing 1.5 g/l of Zn ions, 10 g/l of Mg ions and 5 g/l of Ni ions was applied by spraying to the steel sheet. Then, the steel sheet was washed with water and was dried to prepare a sample of Comparative Example 4.

Performance Evaluation Method:

Film Weight:

The film of each sample is dissolved in an aqueous ammonium dichromate solution and the film weight is calculated by a gravimetric analysis method.

Film Composition:

The components of the film solution described above are determined in accordance with ICP analysis (Induction Coupling Plasma Emission Analysis) to calculate the film composition (%).

Paint Adhesion (Primary):

A 20 μm-thick coating (Amiluck #1000, a product of Kansai Paint K. K.) is sprayed onto each sample by using a sprayer and baking at 140° C. for 20 minutes. The sample is then left standing for a day. Checkerboard scratches with 1 mm gaps (100 squares) reaching the base iron are formed by using an NT cutter and the film is peeled by using a Cellophane tape (××: peel of 100 squares, ×: peel of 99 to 6 squares, Δ: peel of 1 to 5 squares, ○: peel of no square).

Paint Adhesion (Secondary):

The steel sheet coated in the same way as described above is immersed in boiling water for 30 minutes and is left standing for a day. Checkerboard scratches with 1 mm gaps (100 squares) reaching the base iron are formed by using an NT cutter and the film is peeled by using a Cellophane tape (××: peel of 100 squares, ×: peel of 99 to 6 squares, Δ: peel of 1 to 5 squares, ○: peel of no square).

White Rust Resistance:

Edges and the rear surface of each sample are sealed with a tape seal and a brine spray test is conducted in accordance with JIS-Z-2371. 24 hours later, the change of appearance is examined (××: occurrence of red rust, ×: white rust on entire surface, Δ: 10 to 99% of white rust, ○: up to 10% of white rust, ◎: no change at all).

Non-uniform Dew Condensation Resistance:

After 0.5 cc of city water is put drop-wise to each sample, the sample is left standing for day and night, and appearance is examined with eye (×: occurrence of rust, Δ: occurrence of remarkable non-uniformity though no rust, ○: occurrence of extremely slight non-uniformity, ◎:: no occurrence of non-uniformity).

Whiteness:

An L value (lightness) is measured (×: less than 65, ○: 65 to less than 70, ◎:: 70 or more).

Color Tone Uniformity:

Non-uniformity of the color tone is examined with eye (×: a non-uniformity exists, ○: no non-uniformity).

Table 1 shows the result of performance evaluation. Whereas all the examples of the invention provide good performance, some of the performance items are deteriorated in the comparative examples that are outside the range of the present invention.

TABLE 1

| | | | | Performance Evaluation Result | | | | | |
|---|---|---|---|---|---|---|---|---|---|
| | Film | Film Composition | | | | | Non-uniform dew | | |
| | Weight | | Ni, Co, Cu | Paint Adhesiveness | | White Rust | condensation | | Color Tone |
| No | g/m$^2$ | Mg % | % | Primary | Secondary | Resistance | Resistance | Whiteness | Uniformity |
| Example | | | | | | | | | |
| 1 | 0.7 | 3.3 | Ni: 0.6 | ○ | ○ | ○ | ○ | ○ | ○ |
| 2 | 1.2 | 3.3 | Ni: 0.5 | ○ | ○ | ◎ | ◎ | ○ | ○ |
| 3 | 1.6 | 3.3 | Ni: 0.5 | ○ | ○ | ◎ | ◎ | ◎ | ○ |
| 4 | 1.3 | 2.0 | Ni: 0.2 | ○ | ○ | ◎ | ◎ | ○ | ○ |
| 5 | 1.4 | 4.5 | Ni: 0.1 | ○ | ○ | ◎ | ◎ | ◎ | ○ |
| 6 | 1.2 | 3.6 | Co: 0.2 | ○ | ○ | ◎ | ◎ | ◎ | ○ |
| 7 | 1.2 | 3.5 | Cu: 0.2 | ○ | ○ | ◎ | ◎ | ◎ | ○ |
| 8 | 1.5 | 2.6 | Ni: 0.1 | ○ | ○ | ◎ | ◎ | ○ | ○ |
| 9 | 1.0 | 2.0 | Ni: 0.1 | ○ | ○ | ◎ | ◎ | ○ | ○ |
| 10 | 1.2 | 2.0 | Ni: 0.01 | ○ | ○ | ◎ | ◎ | ◎ | ○ |
| Comparative Example | | | | | | | | | |
| 1 | 0.3 | 3.5 | Ni: 0.8 | ○ | Δ | Δ | ○ | ◎ | ○ |
| 2 | 1.4 | 1.5 | Ni: 0.5 | ○ | ○ | X | Δ | X | ○ |
| 3 | 1.3 | 3.9 | 0 | ○ | Δ | Δ | ○ | ○ | X |
| 4 | 1.0 | 1.5 | Ni: 1.5 | ○ | ○ | X | Δ | X | X |

What is claimed is:

1. A galvanized steel sheet having a zinc phosphate film and excellent in corrosion resistance and color tone, wherein said zinc phosphate film contains at least 2% of Mg and 0.01 to 1% of at least one element selected from the group consisting of Ni, Co and Cu, and an adhesion value of said zinc phosphate film is at least 0.7 g/m$^2$.

* * * * *